United States Patent [19]

Phaup et al.

[11] 4,175,889

[45] Nov. 27, 1979

[54] SUBFLOOR FOR OFFSHORE PRODUCTION PLATFORM

[75] Inventors: Charles W. Phaup, Dallas; Joseph D. Lower, Houston, both of Tex.

[73] Assignee: JBC Enterprises, Inc., Houston, Tex.

[21] Appl. No.: 914,963

[22] Filed: Jun. 12, 1978

[51] Int. Cl.[2] ..... E02D 21/00; E04G 1/36

[52] U.S. Cl. ..... 405/195; 405/204; 52/263; 166/335; 175/7; 182/179

[58] Field of Search ..... 61/86, 87, 93, 90, 69 R, 61/50, 101; 182/179, 222, 223; 52/263, 637, 638; 175/7, 9; 166/335

[56] References Cited

U.S. PATENT DOCUMENTS

| | | | |
|---|---|---|---|
| 2,851,311 | 9/1958 | Gibbs | 182/222 |
| 3,378,971 | 4/1968 | Singer et al. | 52/263 |
| 3,665,721 | 5/1972 | Wyllie | 61/101 |
| 4,042,064 | 8/1977 | Lobb | 182/223 |

*Primary Examiner*—Jacob Shapiro
*Attorney, Agent, or Firm*—Marvin B. Eichenroht

[57] ABSTRACT

A subfloor comprising leg-supported modules and drop in panels adapted to be installed in and around a grid of Christmas trees in the well bay area of a production platform.

5 Claims, 7 Drawing Figures

SUBFLOOR FOR OFFSHORE PRODUCTION PLATFORM

This invention relates in general to offshore production platforms; and, more particularly, to an improved subfloor for facilitating access to Christmas trees in the well bay area intermediate the cellar deck and main deck of the platform.

The well bay area is separated from the remainder of a platform of the type contemplated by the present invention by means of a fire wall. The Christmas trees which extend up from the cellar deck of this area are bounded on all four sides by truss columns. These trees are often ten feet or more in height, so that even though their upper ends are spaced below the main deck, it's difficult to have access to valve handles and other parts on them, especially near their upper ends.

Consequently, following installation of the trees and other completion equipment, a subfloor is usually installed intermediate the cellar and main decks and in and around the trees, which are normally arranged in a grid of longitudinally and laterally extending rows. In the past, it has been the practice to individually fabricate each subfloor on the job site, which is a time-consuming and costly process, especially at an offshore location. Also, it often involves a good deal of welding which is dangerous due to volatile materials about the platform.

The principal object of the present invention is to provide a modular type subfloor for this purpose consisting of prefabricated parts which may be installed at the platform with a minimum of time and effort.

This and other objects are accomplished, in accordance with the illustrated embodiment of the invention, by a subfloor comprising a first set of modules each including a floor supported on legs and adapted to be moved laterally into end-to-end position between adjacent lateral rows of trees so as to dispose their floors in horizontal alignment adjacent an intermediate level of the trees, and a second set of modules each also including a floor supported on legs and adapted to be moved alternately into end-to-end position on the outer side of each of the adjacent lateral rows of trees so as to dispose their floors in horizontal alignment with one another and with the floors of the first set of panels. With such modules in place, panels are movable into positions spanning the spaces between and supported on the modules of the first and second sets intermediate adjacent trees in each lateral row of trees, each panel also including a floor which is horizontally aligned with the floors of the other panels and the floors of the modules when so supported.

As will be appreciated, there may be three or more lateral rows of trees in the grid of trees in the well bay area, and thus two or more first sets of modules adapted to be moved laterally between each pair of adjacent lateral rows, with the second set of modules being movable laterally into positions on the outer sides of the outermost lateral row of trees. Still further, this last-described grid having at least three laterally extending rows of trees would require additional panels movable into positions spanning spaces between one of the outermost and the innermost lateral rows of trees.

Obviously, the number of laterally extending rows of trees may be further duplicated, with a corresponding duplication of first sets of modules and panels. Also, the numbers of longitudinally extending rows of trees, and thus the number of trees in each laterally extending row, is unlimited in the sense that the modular type subfloor of the present invention is adapted to accommodate any such number.

Each of the first set of modules has supporting surfaces projecting outwardly from both laterally extending sides of its floor, each of the second set of modules has supporting surfaces projecting outwardly from at least one laterally extending side of its floor, and each of the panels has lower, downwardly facing surfaces along each laterally extending side which are adapted to be lowered onto the supporting surfaces of the modules. More particularly, each module has at least two pairs of legs near its opposite, laterally extending sides, and an elongate plate extending across the upper ends of each pair of legs to support the floor thereabove, with the ends of each plate projecting from the floor to provide the supporting surfaces of the module.

In the preferred and illustrated embodiment of the invention, the first and second sets of modules include intermediate and end modules, with the end modules extending beyond the outer sides of the outermost longitudinally extending rows of trees, and the panels include intermediate and end panels, with the intermediate panels being movable into positions supported on the modules and extending between adjacent trees in each lateral row, and the end panels being movable into positions spanning the spaces between and supported on the end modules. In this manner, the subfloor extends not only between adjacent trees, but also about all four sides of each tree.

In accordance with the preferred embodiment of the invention, cross bars extend between the legs of each pair of legs near their upper ends and spaced beneath the floor to provide a support surface for piping which connects with the trees. The legs are preferably of tubular construction so as to be light weight, and yet have sufficient strength to support personnel on the assembled subfloor, so that they may be manually "walked in" to the space between adjacent lateral rows of trees. The panels are likewise of lightweight construction, being substantially flat in cross section so that they may be easily lifted above the supporting surfaces of the modules and then lowered or "dropped" into supported position.

In the drawings, wherein like reference characters are used throughout to designate like parts:

Figure 1:
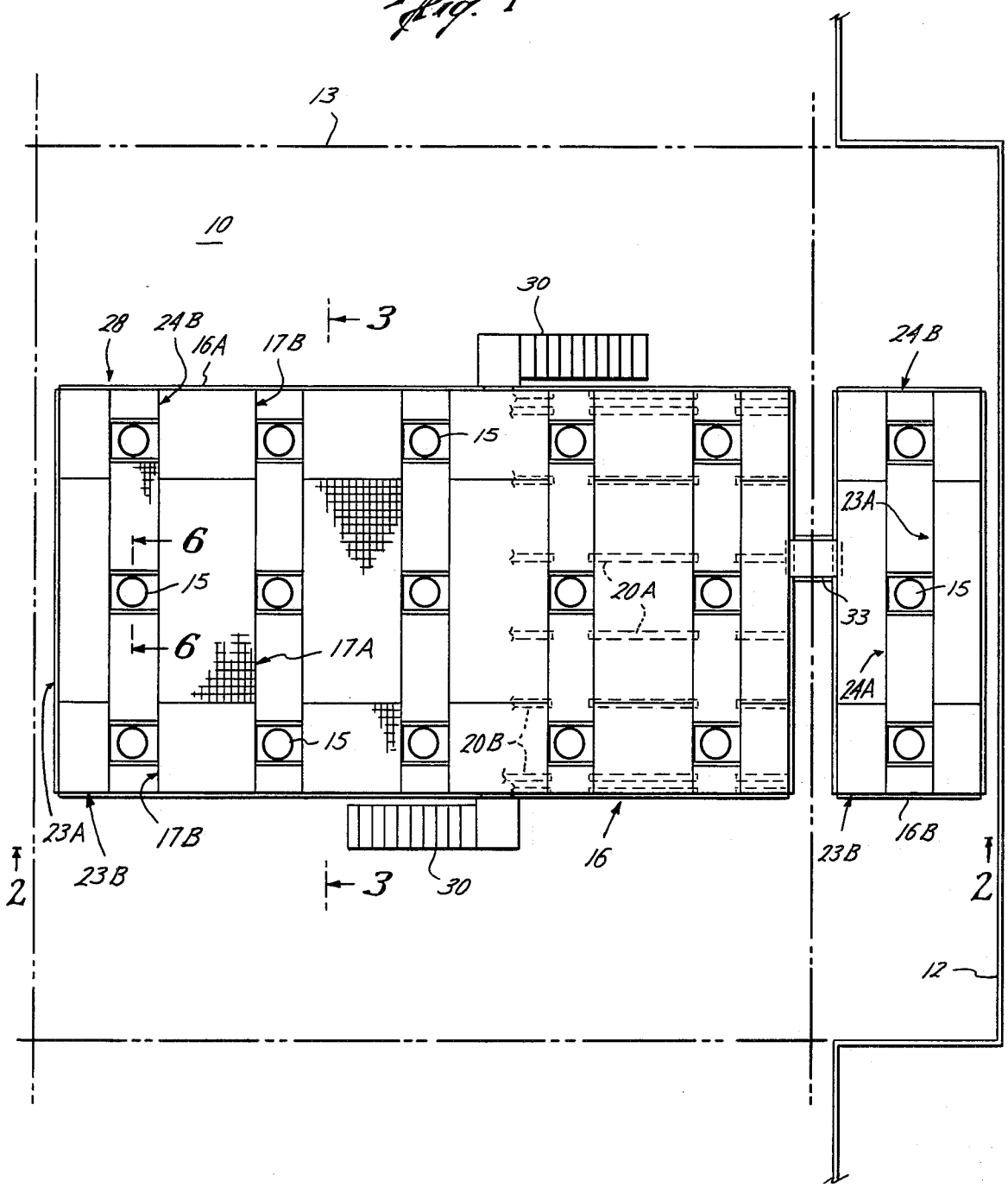
FIG. 1 is a plan view of a subfloor constructed and installed in accordance with the present invention about a grid of Christmas trees in the well bay area of a production platform.
Figure 2:
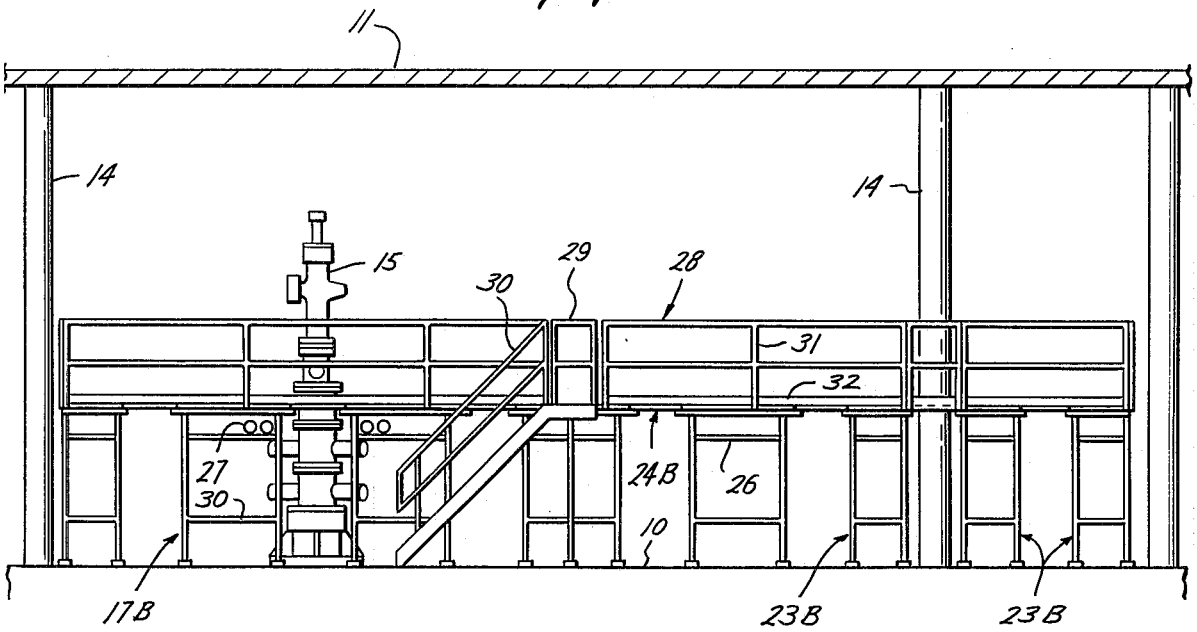
FIG. 2 is a side elevational view of the subfloor shown in FIG. 1, with only one of the trees being shown for purposes of illustration.
Figure 3:
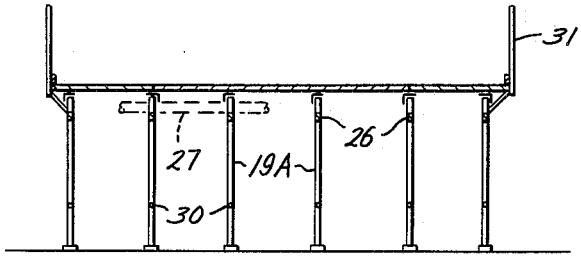
FIG. 3 is a vertical sectional view of the installed subfloor, as seen along broken line 3—3 of FIG. 1, again with the trees removed, and showing in broken lines piping supported on the cross bars of the modules of the subfloor.

With reference now to the details of the abovedescribed drawings, the production platform is best shown in FIG. 2 to include a cellar deck 10 and a main deck 11, which may be spaced approximately 20 feet above the cellar deck. A firewall 12 (see FIG. 1) separates what is known as the well bay area from other facilities on the platform. The well bay area, which is indicated by broken and dash lines 13 in FIG. 1, is bounded by truss columns, such as those indicated at 14 in FIG. 2.

As shown in one instance in FIG. 2 and diagrammatically in FIG. 1, a plurality of Christmas trees 15 are mounted on and extend upwardly from the cellar deck for a substantial height, which may be 10 feet or more. As well known in the art, and as indicated in FIG. 2, these trees include valves which require manipulation from time to time. In a platform of the type contemplated by the present invention, the trees are arranged in a grid consisting, in the illustrated embodiment shown in FIG. 1, of three longitudinally extending rows and six laterally extending rows of trees. In this particular platform illustrated in the drawings, and best shown in FIG. 1, the rightmost laterally extending row of trees is separated from the next rightmost row adjacent thereto by means of a truss column, so that, as will be described to follow, the subfloor 16 comprises two sections, one section 16A to the lefthand of the dividing truss column and another smaller section 16B to the righthand thereof intermediate the righthand truss column and the firewall 12. As previously indicated, the purpose of the subfloor constructed in accordance with the present invention is to permit personnel to have access to those valves and other parts of the trees to which they would otherwise not have access if standing on a cellar deck.

As also previously described, each module of the first set comprises a floor supported on legs, which are preferably arranged in pairs near the opposite, laterally extending sides of the floor. Thus, each intermediate module 17A of the first set includes a floor 18A supported on two pairs of legs 19A, the lower end of each leg having a pedestal which distributes its load and facilitates its being walked into position on the cellar deck between adjacent laterally extending rows of trees. As shown in the drawings, there are two pairs of legs 19A, arranged symmetrically of the ends of the module so as to provide an overhanging portion at each such end. As also shown, a bar 20A comprising an angle extends across the upper ends of each opposite pair of legs so as to distribute the load of the floor over a relatively large area. Also, as will be described to follow, the ends of the bars project from the sides of the module to provide supporting surfaces along the sides of the module 17A.

Each of the end modules 17B of the first set also comprises a floor 18B supported on a pair of legs 19B. More particularly, legs 19B support floor 18B at the same level as floor 18A, and each floor is of the same width so that, when the end and intermediate modules are disposed in end-to-end relation, as shown in the drawings, they will span and form a floor surface between adjacent lateral rows of Christmas trees.

As in the case of the intermediate module 17A, floor 18B is supported on bars in the form of angles 20B extending between the upper ends of a pair of legs 19B. However, the inboard leg 19B is disposed along the innermost end of the module 17B so that the upper surface of angle 20B provides a supporting surface for the adjacent end of intermediate module 17A. The other pair of legs 19B, on the other hand, is disposed inwardly of the outer ends of modules 19B so that there is an overhanging outboard portion of the floor 18B of each module 17B.

This overhang of the floor 18B is supported by means of a brace or strut 21 extending diagonally upwardly from each outboard leg 19B, and a bar in the form of an angle extending laterally between the upper ends of the struts adjacent the outer end of the floor 18B. As will be described to follow, this bracing not only provides support for the overhanging portion of floor 18B, but also provides a supporting surface along the sides of the floor for the second set of modules, as well as a means to which railing (to be described) may be connected about the periphery of the subfloor.

Figure 5:
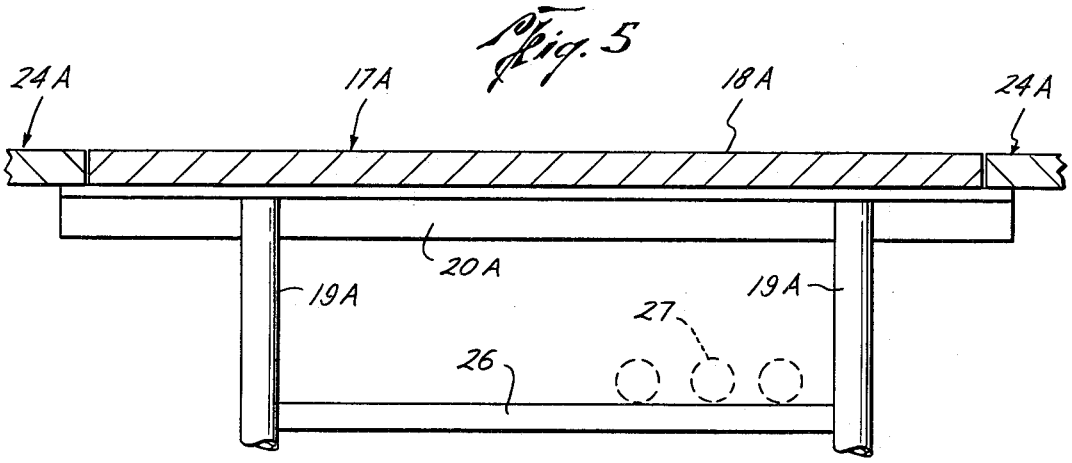
FIG. 5 is a vertical sectional view of one of the modules shown in FIG. 4, as shown along broken lines 5—5 of FIG. 4.

As shown in FIG. 5, the legs of each pair of legs are inboard of the sides of the floor of the modules. Also, a bar or rod 30 extends between to connect the legs of each pair of legs near their lower ends. This not only stabilizes the legs until their lower ends can be welded or otherwise secured to the cellar deck, but also provides a handle which may be grasped near each end of the module to assist in walking it into place.

As will be apparent from FIG. 1, in all but the case of the outermost lateral row of trees, the second set of modules will be identical in size and construction to the first set of modules. However, in the case of the outermost row of trees, the second set of modules disposable on the outboard sides of the outermost rows are of lesser width, substantially half that of the first set, as shown in the drawings, and also differ structurally in that they have supporting surfaces along only their inboard sides.

Figure 4:
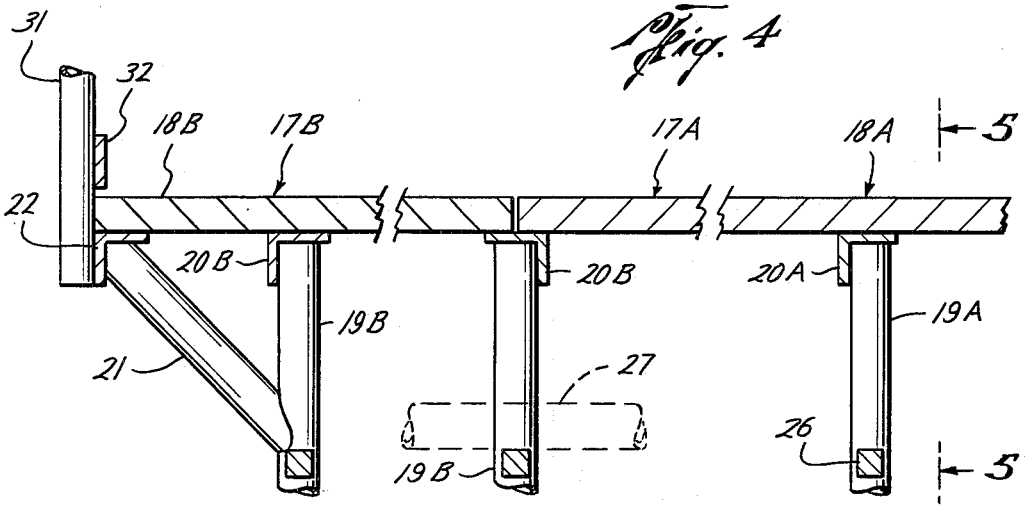
FIG. 4 is an enlarged detail view of the upper ends of the modules of the subfloor, as shown in FIG. 3, with certain parts of the modules being discontinued for purposes of illustration.
Figure 7:
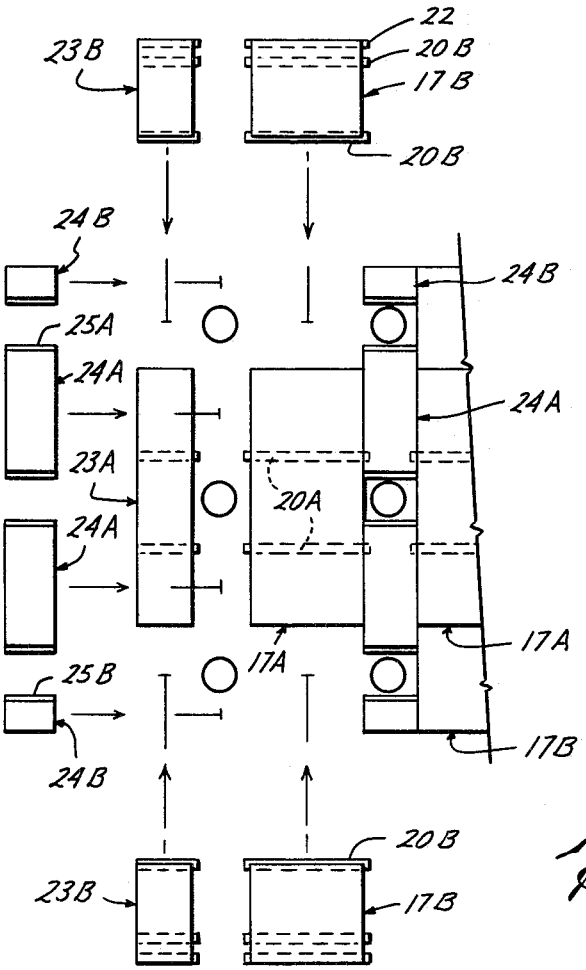
FIG. 7 is a plan view of the modules of panels of the lefthand end of the subfloor shown in FIG. 1, and illustrating in diagrammatic fashion the sequence in which such parts are installed.

Thus, as shown in FIGS. 1 and 7, the second set of modules is also made up of an intermediate module 23A and end modules 23B movable into end-to-end positions on the outer sides of each of the outermost lateral rows of trees. The modules 23A and 23B are identical to the modules 17A and 17B in other respects, including the height of the supporting legs so that the floors of all modules are on the same level. For example, the modules 23A are supported on a pair of legs disposed near opposite sides thereof intermediate the opposite ends of the module, and angles extend across the upper ends of the legs to distribute the load of the floor of each module thereon. Likewise, the end modules 23B of the second set are identical to the end modules 17B in that they are supported by a pair of legs, one of which overlaps the inner edge of its floor and the other of which is disposed toward the outer end of its floor. Still further, the overhanging ends of the floors of the modules 23B may be supported by suitable bracing, as shown in FIG. 4. However, as shown in FIG. 7, the ends of the bars or angles supporting the floor on the upper ends of the legs extend outwardly from only the inboard sides of the modules 23A and 23B, because there is no need for supporting intermediate panels along their outer sides, as will be apparent from the description to follow.

The sequence of installation of the first set of modules and the outboard set of second modules is illustrated in FIG. 7. Thus, intermediate module 17A has been walked into place between the outboard lateral row of trees and the row adjacent thereto, and the projecting supporting surfaces on its right side have been moved into supporting positions beneath the edge of the floors on the left sides of adjacent panels. With the intermediate module in place, the end modules 17B are then moved into place, as a result of which the righthand projecting end supporting surfaces of bar 20B have been moved beneath the unsupported end edge of the floor of intermediate panel 24A and the unsupported end edge of the floor of one of end panels 24B, while the projecting end surfaces on bar 22 have been moved beneath the other unsupported end edges of the floors of such end panels.

At this time, the second set of modules is installed on the outboard side of the outermost row of trees, with the intermediate module 23A first being moved into the position shown in FIG. 7, and the end modules 23B then being moved into positions in end-to-end relation with module 23A. The modules 17A and 23A are of the same length, and their ends are substantially laterally aligned, and when the end modules 23B of the second set are moved into place, their outer ends are substantially aligned with the outer ends of the end modules 17B of the first set. As the end modules 23B are moved into place, the supporting surfaces on their inner ends will be moved beneath the outer ends of the floor of the intermediate module 23A.

As previously described, panels 24A and 24B are then moved into positions spanning the spaces between and supported on the modules of the first and second sets intermediate and on the outer ends of adjacent trees in each lateral row of trees. As previously described, these panels are "dropped" into place by being moved laterally over the floors of the installed modules and then lowered onto their supporting surfaces thereof. There are two pairs of panels 24A and 24B, with the pair of panels 24A being disposed between the centermost and outermost trees of each lateral row, and the panels 24B on the outer sides of the outermost trees of each lateral row. Each such panel comprises a floor which will be horizontally aligned with the floors of the other panels and the floors of the modules on which they are supported.

Figure 6:
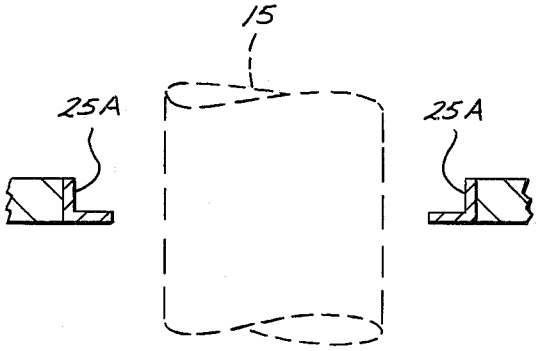
FIG. 6 is an enlarged cross-sectional view, as seen along broken lines 6—6 of FIG. 1, of the ends of a pair of panels adjacent a tree shown in broken lines as extending therebetween.

Each panel 24A has an angle 25A fixed to each end thereof, and each panel 24B has an angle 25B fixed to each inner end thereof. As best shown in FIG. 6, these angles provide horizontally disposed supporting surfaces beneath the surface of the floor of the panel, all for a purpose to be described.

The panels 24A and 24B may be moved in any desired sequence into supporting position on the supporting surfaces of the modules of the first and second sets, with panels 24A being supported on oppositely facing sides of the intermediate modules 17A and 23A as well as upon the projecting supporting surfaces on the oppositely facing sides at the inner ends of the end modules 17B and 23B. The end panels 24B, on the other hand, are supported by the disposal of the edges of their opposite sides on the supporting surfaces provided by the outboard legs of the modules 17B and 23B as well as by the projecting supporting surfaces of the opposite ends of the bars 22 across the ends of the floor of each such module. The panels are of such length as to be spaced slightly from the trees which they surround, and the supporting surfaces on angles 25A provide a means by which a blank cover may be disposed over an opening in the subfloor when a tree does not extend through that opening.

As best shown in FIG. 5, rods 26 extend between at least certain of the legs 19A of the modules 17A, above rods 30 and near the module floor. More particularly, the rods are disposed on substantially the same level so as to provide a supporting surface for piping 27 for connection with the Christmas trees.

As best shown in FIG. 2, rails 28 are disposed continuously about all four sides of the installed subfloor, except for openings which receive gates 29 providing access to and from stairways 30 from the cellar deck to the subfloor. As best shown in FIG. 4, upright members 31 of the rails may be secured to the outer ends of the floor of the module 18B as well as the angle extending thereacross. In addition, kick plates 32 may be secured to and extend between the upright members.

As best shown in FIGS. 1 and 2, the smaller section 16B of the subfloor includes modules 23A and 23B disposed on each side of the rightmost lateral row of trees. In other respects, the installation of both the modules and the panels is identical to that described in connection with the larger section 16A of the subfloor. Access may be had between the two sections by means of a panel 33 which is dropped into spanning position between them to provide a walkway. This panel may be substantially identical to the panel 24A in that it includes a floor whose opposite side edges are adapted to be lowered into supported positions on supporting surfaces of modules of the second set.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A modular type subfloor in the well bay area to facilitate access to laterally and longitudinally extending rows of Christmas trees rising above the cellar deck beneath the main deck of the well bay area of an offshore production platform, said subfloor comprising a first set of modules each comprising a floor supported on legs and adapted to be moved laterally into end-to-end position between adjacent lateral rows of trees to dispose their floors in horizontal alignment adjacent an intermediate level of the trees, a second set of modules each also comprising a floor supported on legs and adapted to be moved laterally into position on the outer side of each of the adjacent lateral rows of trees to dispose their floors in horizontal alignment with one another and with the floors of the first set of modules, and panels movable into positions spanning the spaces between and supported on the modules of the first and second sets intermediate adjacent trees in each lateral row of trees, each panel comprising a floor which is horizontally aligned with the floors of the other panels and the floors of the modules when so supported.

2. A subfloor of the character defined in claim 1, wherein each of the first set of modules has supporting surfaces projecting outwardly from the opposite, laterally extending sides of its floor, each of the second set of modules has supporting surfaces projecting outwardly from a laterally extending side of its floor, and each of the panels has lower, downwardly facing surfaces along each laterally extending side which are adapted to be lowered onto the support surfaces of the modules.

3. A subfloor of the character defined in claim 2, wherein each module has at least two pairs of legs near its opposite, laterally extending sides, and an elongate plate extending across the upper ends of each pair of legs to support the floor thereabove, the ends of each plate projecting from the sides of the floor to provide said supporting surfaces.

4. A subfloor of the character defined in claim 1, wherein the first and second sets of modules extending beyond the outer sides of the outermost longitudinally extending rows of trees, and said panels include intermediate and end panels, the end panels being movable into positions spanning the spaces between and supported on the end modules of the first and second sets.

5. A subfloor of the character defined in claim 1, wherein the legs of each module are arranged in pairs one near each side thereof, and bars extend between the legs of each pair and are spaced beneath the floor and on generally the same level to provide a support surface for piping connecting to the trees.

* * * * *